United States Patent [19]

Westdale et al.

[11] 4,355,088

[45] Oct. 19, 1982

[54] POLYETHYLENE PRESSURE FIXABLE ELECTROSCOPIC PRINTING POWDER AND PRESSURE FIXING METHOD

[75] Inventors: Virgil W. Westdale, Barrington, Ill.; John Novotny, Jr., Denville, N.J.

[73] Assignee: Am International, Inc., Chicago, Ill.

[21] Appl. No.: 32,647

[22] Filed: Apr. 23, 1979

Related U.S. Application Data

[60] Continuation-in-part of Ser. No. 782,609, Mar. 30, 1977, abandoned, which is a continuation-in-part of Ser. No. 655,466, Feb. 5, 1976, abandoned, which is a division of Ser. No. 437,273, Jan. 28, 1974, abandoned.

[51] Int. Cl.[3] ..... G03G 13/20; G03G 9/08

[52] U.S. Cl. ..... 430/98; 430/106; 430/109; 430/110

[58] Field of Search ..... 430/110, 98, 106, 109

[56] References Cited

U.S. PATENT DOCUMENTS 4,108,653 8/1978 Peters ..... 430/109

*Primary Examiner*—Roland E. Martin, Jr.
*Attorney, Agent, or Firm*—Nicholas A. Camasto

[57] ABSTRACT

A pressure fixable toner for electrostatic image development, which can be fixed upon a receiving member by pressure, is formulated with a high density, low molecular weight polyolefin, one or more coloring agents, and optionally, other adjuvants.

15 Claims, No Drawings

POLYETHYLENE PRESSURE FIXABLE ELECTROSCOPIC PRINTING POWDER AND PRESSURE FIXING METHOD

This application is a continuation-in-part of United States Patent Application Ser. No. 782,609, filed Mar. 30, 1977, now abandoned, which is a continuation-in-part of United States Patent Application Ser. No. 655,466, filed Feb. 5, 1976 and now abandoned, which is a division of United States Patent Application Ser. No. 437,273 filed Jan. 28, 1974, now abandoned.

BACKGROUND OF THE INVENTION

This invention relates to electroscopic printing powders useful for developing latent electrostatic images produced by photoelectrostatic copying techniques into visible material images. More particularly, the invention relates to electroscopic powders which have been formulated with low molecular weight, high density polyolefinic resins which improve fixability of the powders onto copy sheets through the use of pressure.

Photoelectrostatic copying processes in which a photoconductive medium is imaged to produce a differential electrostatic charge which is then developed with an electroscopic powder are well known. A wide variety of photoconductive media may be employed such as inorganic photoconductive insulating crystalline metal ion containing materials, organic photoconductors and elemental photoconductors.

A wide variety of techniques are known for developing the differentially charged photoconductive medium such as magnetic brush, powder cloud, liquid development and cascade developing techniques.

The formulation of electroscopic powders to be compatible in a particular photoelectrostatic copying environment has been widely explored in this art and is well developed. For the most part, the powders are applied by the various techniques mentioned hereinabove and ultimately the powder image requires fixing so that it will adhere to the copy material. The copy material may be photoconductive itself, such as in the case of zinc oxide coated paper. In other processing systems, the powder image is first produced on a photoconductive drum and then transferred to a sheet of plain paper where the powder image must be fixed. In either case, the electroscopic powder requires that it be permanently fixed to the material which is to become the permanent copy.

In the copying systems disclosed heretofore, the techniques of fixing the image onto the copy depended on the use of heat in order to fuse the thermoplastic resin powder onto the copy material. The use of heat energy is generally acceptable, but it is not without serious deficiencies. For example, the equipment requires that it be warmed up to an operating temperature level where the heating system will properly fuse the powder. The presence of heat presented the hazard of igniting the papers in the circumstance that there is a paper jam in the paper delivery system, and at the very least was known to char the papers.

In terms of the design of the equipment the use of heat required provision for large power inputs to the equipment which made it costly to manufacture and maintain.

Another undesirable aspect of using heat to fuse the powder images is the introduction of heat into the working environment causing some discomfort.

One important consideration is the time which is required to impart sufficient heat to the thermoplastic powder so that it will properly soften and coalesce. In most copying systems, the rate of output of reproductions is only as fast as the slowest processing step, which heretofore was the heat fusing operation.

Electroscopic powders have been suggested which are formulated especially for pressure fusing. It has been found, however, that they tend to produce reproductions whose images are either of poor resolution or have poor image densities unless extremely high pressure are used.

It is taught in U.S. Pat. No. 3,775,326 to Virgil W. Westdale assigned to the same assignee as this invention that by compounding the prior art toners which were primarily heat fusible with a polyolefinic resin in the range of 2% to 15% based on the weight of resin, these formulations then became uniquely and surprisingly responsive to pressures in the range of 300 pounds per lineal contact inch so that they could be permanently bonded to the image receiving surface.

OBJECTS

It is a general object of the instant invention to provide an improved electroscopic powder having utility in high speed photoelectrostatic copying machines which can be used to equal advantage in systems which require the image powders to be fused by heat or by pressure.

It is another object of this invention to provide toners characterized by improved fixability.

It is another object of the instant invention to provide an improved electroscopic powder for use in high output photoelectrostatic copying machines capable of producing high quality images when fixed by pressure.

It is another object of the instant invention to provide an electroscopic powder which is specifically adapted for high volume photoelectrostatic copying machines employing a magnetic brush developer system.

It is a further object of this invention to provide an electroscopic powder which results in less rub-off and greater permanence than previously available electroscopic powders.

Other objects and advantages will become apparent from the following detailed disclosure and description of the invention.

SUMMARY OF THE INVENTION

It has now been found that electroscopic powders comprising from about 70% to about 95% by weight of low molecular weight, high density polyolefins result in formulations which are readily fixed by pressure or by heat, and are especially suited for pressure fixing. These formulations effectively produce images highly resistant to rub-off and of improved permanence.

DESCRIPTION OF THE PREFERRED EMBODIMENTS

The new electroscopic powders comprise a low molecular weight, high density polyolefin in the range of about 70% to about 95% by weight and various coloring agents. Certain adjuvants may also be present in these powders. Powders containing less than 70% by weight polyolefin do not display the fixing permanence characteristics desired. Amounts larger than 95% by weight do not permit use of sufficient pigment or dye to effectively orient the powders.

The various ingredients of the new powders must be compatible with one another in their molten state. As used herein, compatibility means that the ingredients must be dispersible or otherwise soluble in one another.

As used herein, the term "polyolefin" means a high density, low molecular weight resin selected from the group consisting of polymethylenes, polyethylenes, oxidized polymethylenes and oxidized polyethylenes. These polyolefins have a molecular weight in the range of about 800 to about 5,000. They have a density in the range of from about 0.94 to about 0.98 gram per cubic centimeter, preferably from about 0.95 to about 0.97 gram per cubic centimeter. They do not soften or become tacky at temperatures below about 50° C.

The polyolefins also have a high degree of crystallinity, generally in the range of about 75% to about 98%, and preferably in the range of about 80% to about 95%. The degree of crystallinity is influenced considerably by the rate at which the polyolefins are cooled from a molten state. In general, the slower the cooling rate, the higher the degree of crystallinity will be, and vice versa.

The polyolefins generally resist wear and tear better than lower density materials. Their flow rate is also better than the flow rate of lower density polyolefins. Because these materials are tough, they must be milled to reduce them to acceptable particulate sizes for use in electroscopic developers. Preferably, we mill these polyolefins in a Jet Brand air jet mill which we operate in the range of about 100 to about 130 pounds per square inch to convert from about one pound to about ten pounds per hour of polyolefin to acceptable particulate sizes.

Among the polyolefins that are suitable for use in the new electroscopic powders are Polywax 2,000, available from the Bareco Division, Petrolite Corporation, Tulsa, Okla.; Epolene N 45, available from Eastman Chemical Co., Rochester, N.Y.; TR-885, available from Phillips Petroleum Company, Pasadena, Tex.; Polyethylene AC-690, AC-680, AC-392 and AC-9, all available from Allied Chemical Corporation, Morristown, N.J.; DOWC-0355 and CPR-1, available from Union Carbide Corporation, New York, N.Y.; and Paraflint RG, available from Moore and Munger Corporation, Stamford, Conn., and other similar materials.

In addition to the polyolefin, the powders of this invention should contain from about 1% to about 10% by weight of one or more coloring agents. Useful coloring agents are pigments and/or dyes which not only produce the coloration desired in copies made from the toners of this invention, but also assist in effectively orienting the toner upon the copy material or other photoconductive surface. Suitable coloring agents include various forms of carbon black, and blue and black dyes. Examples are oil soluble Blue G A, Capital Color and Chemical Company, Wilmette, Ill.; Cromophthal Blue A-4R, Capital Color and Chemical Company, Wilmette, Ill.; Sudan Deep Black B B, General Aniline and Film Corp., New York, N.Y.; Calco Indulene Base 5G, American Cyanamid Co., Bound Brook, N.J.; Nubian Resin Black, Allied Chemical Corp., Morristown, N.J. and Z 1630, available from American Cyanamid, Rosemont, Ill.

The electroscopic powders may, but need not, also include adjuvants which serve various purposes. For example, high molecular weight aliphatic amides may be used to decrease the melt viscosity of certain polyolefins. Suitable materials are the Armids, available from Armak Co., Chicago, Ill. The amides may be used in a range from about 1% to about 29% weight of the composition.

Another suitable adjuvant is a quaternary ammonium surface active agent, which may be used in a range of from about 1% to about 10% by weight of the composition. Such materials include, but are not limited to Arquads, available from Armak Co., Chicago, Ill., and Cetats, available from Fine Organics, Inc., Lodi, N.J.

Another optional adjuvant is a metal soap such as, for example, a zinc, barium or cadmium soap of a $C_{12}$ to $C_{18}$ carboxylic acid. Examples are stearic, lauric and palmitic acid. Such soaps are desirable where the new toners will be exposed to excessive stress in high speed machines. Where metal soaps are used, they should comprise from about 0.01% to about 7.0% by weight of the powders.

These soaps prolong the life of powders when they are tumbled and compacted rapidly in machines producing 50 copies or more per minute, and are particularly effective when a copier is run for long periods of time at high speeds. For example, a powder of this invention containing no metal soap might produce 8,000 to 12,000 acceptable copies on a given machine, but may well produce 100,000 or more acceptable copies on the same machine where metal soap is present. However, metal soaps are unnecessary where a copier is operated at slow copying speeds, or at high speeds intermittently. Acceptable toners which are both pressure and heat fixable can be produced without these metal soaps.

In preparing the electroscopic powders of this invention the various coloring agents such as pigments and dyes are mixed with any adjuvant which is used, the polyethylene is melted and the metal soap if used is mixed with the polyethylene and the mixture of coloring agents and adjuvants (if any) is added. After thoroughly mixing the resulting formulation, the molten mass is removed from the mixing vessel, poured into shallow pans and cooled, preferably slowly, to promote a high degree of crystallinity. The large wafers that form in this process are then crushed and pulverized to an average particle size ranging from under one micron to about fifty microns.

The powder is classified according to particles which pass through a 100-mesh screen so that the largest particle size is under 149 microns.

To prepare a developer mix, the powder is combined with a suitable carrier. The ratio of toner to carrier should be in the range of about 1:15 to about 1:80. For example, iron particles may be used to form a toner for use with a magnetic brush system. In that case the ratio of toner powder to iron is about 1:35 to 1:40. Where glass beads of the type used in cascade systems are the carrier, the ratio of toner to beads may be, for example, about one to eighty.

The following examples are given to illustrate the preferred embodiments of this invention. It will be understood that these examples are merely for the purpose of illustration.

In all examples, the amounts shown represent percent by weight of the total electroscopic powder formulation.

EXAMPLE 1

| Ingredient | Percent |
|---|---|
| Polyethylene | |

-continued

| Ingredient | Percent |
|---|---|
| CPR - 1 | 88.1 |
| Zinc laurate | 4.4 |
| Carbon Black | |
| ELF - 5 (Cabot Carbon Co.) | 2.9 |
| Nubian Resin Black | 4.6 |

A quantity of 600 grams of the polyethylene was melted in a half gallon can, 30 grams of zinc laurate was added thereto, and melted at 350° F., and the resulting mix was agitated at 4,000 rpm. Then 20 grams of carbon black was added and dispersed well with high agitation at 4,500 rpm. Next 31.5 grams of Nubian Resin Black was added and dispersed at 4,500 rpm., and the temperature was reduced from 350° F. to 320° F. over a period of about 15 minutes. The resulting mixture was then jet-milled at 110 pounds per square inch, converting 3¾ pounds of the mixture to powder per hour.

A developer mix using 35 parts by weight of iron carrier particles to 1 part by weight of the toner prepared according to the foregoing description was placed in one gallon can and rolled on a roll mill for a half hour.

The resulting developer mix was used in a commercial electrostatic copying machine, the A-M 5000 manufactured by Addressograph-Multigraph Corporation which utilizes pressure fixing.

Dense, sharp images were obtained using zinc oxide coated paper and this developer. Excellent fixing to the paper substrate was realized by applying a pressure in the range of from about 175 to 350 pounds per lineal contact inch between the pressure rollers of this machine.

Other formulations used with similar results had the compositions shown in Table 1 below.

TABLE 1

| | Percent | | | | | |
|---|---|---|---|---|---|---|
| Ingredient | A | B | C | D | E | F |
| Polyethylene | 86.0 | 90.1 | 86.8 | 89.3 | 90.2 | 85.7 |
| Zinc laurate | 6.5 | 2.2 | 4.3 | 4.5 | 4.5 | 4.3 |
| Carbon black | 2.9 | 3.0 | 4.3 | 1.5 | 3.0 | 2.9 |
| Nubian Resin Black | 4.6 | 4.7 | 4.6 | 4.7 | 2.3 | 7.1 |

EXAMPLE 2

| Ingredient | Percent |
|---|---|
| Polyethylene Polywax 2000 | 84.4 |
| Quaternary ammonium surface active agent | 4.2 |
| Zinc laurate | 4.2 |
| Carbon Black (ELF-5) | 2.8 |
| Nubian Resin Black | 4.4 |

Into a half gallon can we put 600 grams of the polyethylene which was heated until completely melted. The quaternary ammonium surface active agent was then added, and the mixture was agitated at as high an rpm. as possible without splashing. The zinc laurate was then added, melted into the mixture and well agitated. Carbon black was then added and dispersed with agitation. Finally the Nubian Resin Black was added and dispersed by agitating the mixture. The temperature varied from a low of 310° F. to a high of 370° F. during the formulation. The resulting mixture was then jet-milled at 110 pounds per square inch on a 4-inch mill, to convert 8½ pounds per hour of the formulation into a powder.

A developer was prepared using 3200 grams of iron particles (+230 mesh) and 91.5 grams of the toner described above (−170 mesh).

This developer mix was utilized in the same commercial electrostatic copying machine as described in EXAMPLE 1. The copies made using zinc oxide coated paper were good with dense images. No reversal tendencies were observed. Pressure fixing was observed to give excellent results with this toner.

What is claimed is:

1. A method for producing a developed image of a graphic original on a photoconductive member comprising the steps of:

uniformly charging the photoconductive member;

exposing the charged member to a pattern of light and shadow to produce a differential charge pattern thereon;

developing the pattern by applying thereto a mixture of carrier particles and an electroscopic powder having an average particle size ranging from under 1 micron to about 50 microns, said developer powder including from about 70% to 95% by weight of a polyolefin having a density of about from 0.94 to about 0.98 gram per cubic centimeter, a degree of crystallinity in the range of about 75% to about 98%, and molecular weight in the range of from about 800 to about 5,000, and an orienting coloring agent in the range from about 1% to about 10% by weight of the powder, where the ratio by weight of the powder to the carrier is in the range of from about 1:15 to about 1:80, and fixing the developed powder image by means of pressure alone.

2. The method of claim 1 wherein the powder also comprises at least one adjuvant selected from the group consisting of about 1% to about 29% by weight of high molecular weight aliphatic amide, from about 1% to about 10% by weight of a quaternary ammonium surface active agent, and from about 0.01% to about 7.0% by weight of a zinc, barium or cadmium soap of a $C_{12}$ to $C_{18}$ carboxylic acid.

3. A toner composition comprising carrier particles and a developer powder having an average size in the range of from under 1 micron to about 50 microns, said developer powder comprising about 70% to about 95% by weight of a polyolefin having a density of from about 0.94 to about 0.98 gram per cubic centimeter a degree of crystallinity in the range of about 75% to about 98%, and molecular weight in the range of from about 800 to about 5,000, and an orienting coloring agent in the range from about 1% to about 10% by weight of the powder, where the ratio by weight of the powder to the carrier is in the range of from about 1:15 to about 1:80.

4. The toner composition of claim 3 wherein the powder also comprises at least one adjuvant selected from the group consisting of about 1% to about 29% by weight of said powder of a high molecular weight aliphatic amide, from about 1% to about 10% by weight of said powder of a quaternary ammonium surface active agent, and from about 0.01% to about 7.0% by weight of said powder of a zinc, barium or cadmium soap of a $C_{12}$ to $C_{18}$ carboxylic acid.

5. Pressure-fixable toner powder comprising particles which consist essentially of thermoplastic binder having dispersed therein colorant and, optionally, additives, characterized in that said binder comprises predominantly, in an amount rendering said particles readily fixable to a receiving surface by pressure, a polyethylene having a weight average molecular weight of about 800 to about 5,000, a crystallinity of about 75% to about 98% and a density of about 0.94 to about 0.98.

6. Toner powder according to claim 5, said polyethylene having a crystallinity of about 80% to about 95%.

7. Toner powder according to claim 5, said polyethylene constituting about 70 to about 95 percent by weight of the toner powder.

8. Toner powder according to claim 5, said particles containing carbon black.

9. Toner powder according to claim 7, said particles containing between 1.5 and 4.3 percent by weight of carbon black.

10. Toner powder comprising selectively sized particles, ground from a solid mass, consisting essentially of thermoplastic binder composed predominantly of a polyethylene having an average molecular weight of approximately about 800 to about 5,000, a crystallinity of about 80% to about 95% and a density of about 0.94 to about 0.98, and pigment dispersed in said binder.

11. Process for forming fixed visible images comprising the steps of developing an electrostatic image with a toner powder, and fixing the resulting powder image on a substrate by applying pressure thereto, characterized in that said toner powder is a toner powder according to claim 5.

12. Process for forming fixed visible images comprising the steps of developing an electrostatic image with a toner powder, and fixing the resulting powder image on a substrate by applying pressure thereto, characterized in that said toner powder is a toner powder according to claim 9.

13. Process for forming fixed visible images comprising the steps of developing an electrostatic image with a toner powder, and fixing the resulting powder image on a substrate by applying pressure thereto, characterized in that said toner powder is a toner powder according to claim 10.

14. Toner powder according to claim 10, said pigment comprising carbon black.

15. A toner powder as set forth in claims 5 or 6, wherein said density is from about 0.95 to about 0.97 gram per cubic centimeter.

* * * * *